United States Patent [19]

Torii

[11] Patent Number: 4,949,712

[45] Date of Patent: Aug. 21, 1990

[54] BODY SHAKING DEVICE

[76] Inventor: Masakatsu Torii, 40-9, Kamiya 2-chome, Kita-ku, Tokyo, Japan

[21] Appl. No.: 345,011

[22] Filed: Apr. 28, 1989

[30] Foreign Application Priority Data

May 19, 1988 [JP] Japan ..... 63-65190[U]
Feb. 21, 1989 [JP] Japan ..... 1-18452[U]

[51] Int. Cl.[5] ..... A61H 1/02
[52] U.S. Cl. ..... 128/25 R; 272/144
[58] Field of Search ..... 128/25 R, 25 B, 73, 128/74, 69, 70, 48, 49, 51, 52, 33; 272/144, 134, 126, 127, 97, 146

[56] References Cited

U.S. PATENT DOCUMENTS

| | | | |
|---|---|---|---|
| 2,093,830 | 9/1937 | Flatley | 128/25 R |
| 2,908,271 | 10/1959 | Ware | 128/33 |
| 2,924,214 | 2/1960 | Zak | 128/25 R |
| 3,544,103 | 12/1970 | Conable | 128/33 X |
| 3,791,645 | 2/1974 | Stelma | 272/97 |
| 4,506,884 | 3/1985 | Hawkin | 272/127 |
| 4,743,014 | 5/1988 | Loane | 272/97 |
| 4,760,841 | 8/1988 | Holler | 128/33 |

*Primary Examiner*—Richard J. Apley
*Assistant Examiner*—Robert Bahr
*Attorney, Agent, or Firm*—M. Reid Russell

[57] ABSTRACT

A body shaking device for shaking a user's body by an application of a side to side mechanical force thereto. The body shaking device includes a leg rest that is movable along a pair of parallel track sections that extend across a casing, the leg rest to receive the terminal parts of both of a user's legs who is reclining on a hip rest assembly or on a floor. The leg rest is reciprocated along the track by a remotely operated motor, such that the terminal parts of both the user's legs are shaken from side to side, with this movement consequently transmitted to their whole body that is thereby shaken, which shaking movement is similar to that as occurs when a rope end is forcibly moved from side to side.

6 Claims, 9 Drawing Sheets

FIG. 15
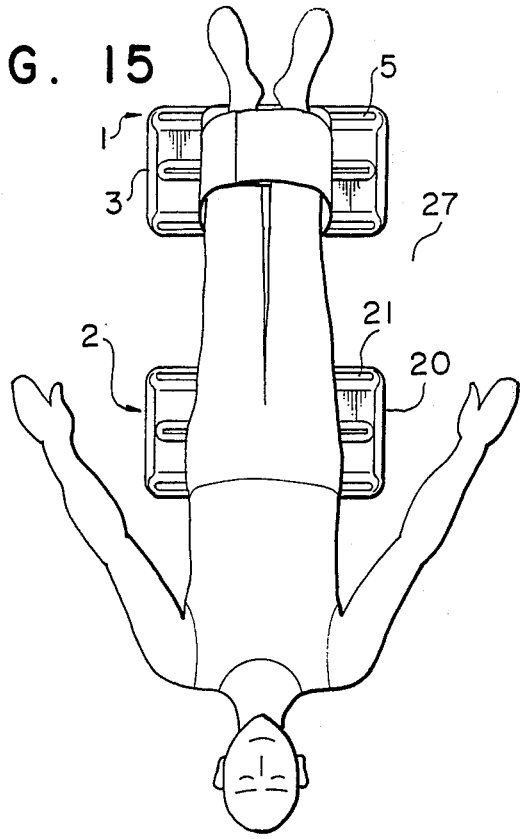
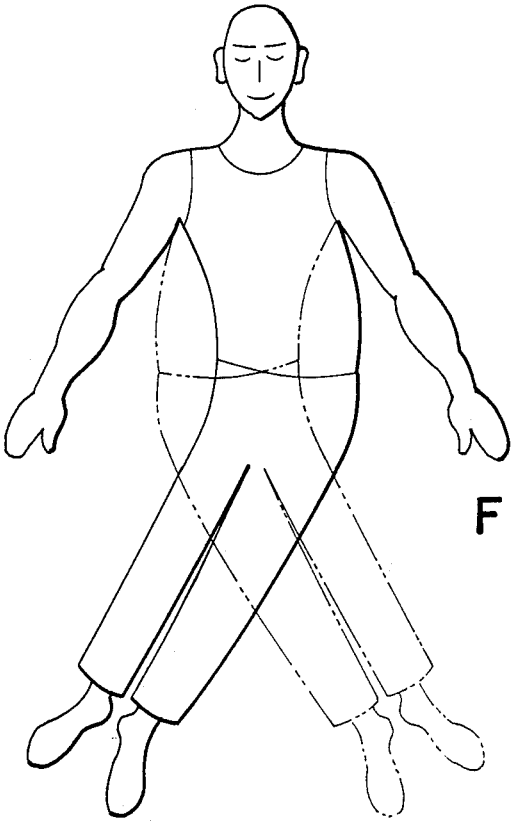
FIG. 17

BODY SHAKING DEVICE

BACKGROUND OF THE INVENTION

1. Field of the Invention

The present invention relates to mechanical exercise devices and particularly to a body shaking device.

2. Prior Art

It is known that deformity or abnormal curvature of the spine can result in compression of the spine to cause various visceral failures, stiff shoulder, lumbago, constipation and the like. However, in actuality, almost all people have some deformity of the spine, although there are great differences between people in the degree of such deformity. The modes of deformity of the spine include a curving in the forward or backward direction (i.e. lordosis or kyphosis) and the sideward direction (scoliosis). Although some of these deformities are formed naturally, other deformities of the spine are gradually and unconsciously acquired after the birth through daily customs and the types of work in which the person is engaged.

In order to alleviate the above-described deformities of the spine and resultant visceral failures, stiff shoulder, lumbago and the like, there have been developed various devices which have been marketed. Such conventional devices are broadly categorized into the following types:

(a) stretching the spine by a user who grasps and hangs from a horizontal bar;

(b) applying rollers to both sides of the spine;

(c) arching the spine backward; and (d) massaging the spine and thereabout by use of a vibrator.

However, each such conventional device is intended for curing the deformity of the spine in the forward or backward direction. Heretofore, within the knowledge of the inventor, there has never been a device that was intended to cure a sideward deformity of the spine.

SUMMARY OF THE INVENTION

Therefore, it is a principal object of the present invention to provide a body shaking device by which the terminal parts of both legs of a user are moved from side to side by means of a mechanical force such that every part of his or her body can be shaken in a similar manner to when one end of a rope is shaken from side to side, resulting in every part of the rope being shaken in waves.

It is another object of the present invention to provide a body shaking device that is capable of relieving a sideward deformity of the spine.

It is a further object of the present invention to provide a body shaking device that is capable of alleviating stiffness in a user's back.

It is still another object of the present invention to provide a body shaking device that is capable of giving massaging effects to a user's waist and shoulder areas.

It is yet another object of the present invention to provide a body shaking device that is capable of affording a person an exercise that will effect their waist, and abdominal regions like that a person can provide when he or she performs exercise for their abdominal muscles, and the like.

In accordance with the above-described objects, the present invention is in a body shaking device that includes a casing mounting a first track on a top surface thereof that extends from side to side, with a leg rest arranged to move on this track. The leg rest is to receive the terminal parts of both legs, preferably, the portions from calves to ankles, rested thereon. The leg rest is reciprocatorily moved along the first track by driving means.

It is well known that, when one end of a rope is grasped by hand and quickly moved from side to side, this side to side shaking of the rope end portion induces a series of wave motions which are transmitted to the other rope end, such that every part of the rope is shaken in waves. In the body shaking device of the present invention, when the user lies down in supine posture, with the terminal parts of both legs rested on the leg rest, and by moving the leg rest side to side along the first track, by a driving means, the terminal portions of both of the user's legs are moved from side to side. This side to side leg movement provides a shaking to every part of the user's body that is somewhat like that induced in a rope by shaking it.

In one embodiment of the present invention, a separate or second casing or base is provided for mounting a hip rest that is movable back and forth along a second track mounted to the top surface of that second casing or base, the second track extending from side to side thereon. In practice, the user rests his or her hips on this hip rest with the second track disposed parallel to the first track. Thus, when the terminal parts of both legs are moved from side to side as aforesaid, the hip rest and the user's hips thereon are moved reciprocatorily thereto along the second track, thereby freely shaking every part of the user's body.

BRIEF DESCRIPTION OF THE DRAWINGS

The foregoing and the other objects, features and advantages of the present invention will become apparent from the following detailed description when taken in connection with the accompanying drawings. It is, however, to be understood that the drawings are designed for the purpose of illustration only and are not intended as a definition of the limits of the invention.

FIG. 15 is a top plan view showing a person supported on the leg and hip rests;

FIG. 17 is an explanatory top plan view showing how a user's body is shaken during operation of the body shaking device.

DETAILED DESCRIPTION OF THE DRAWINGS

Figure 1:
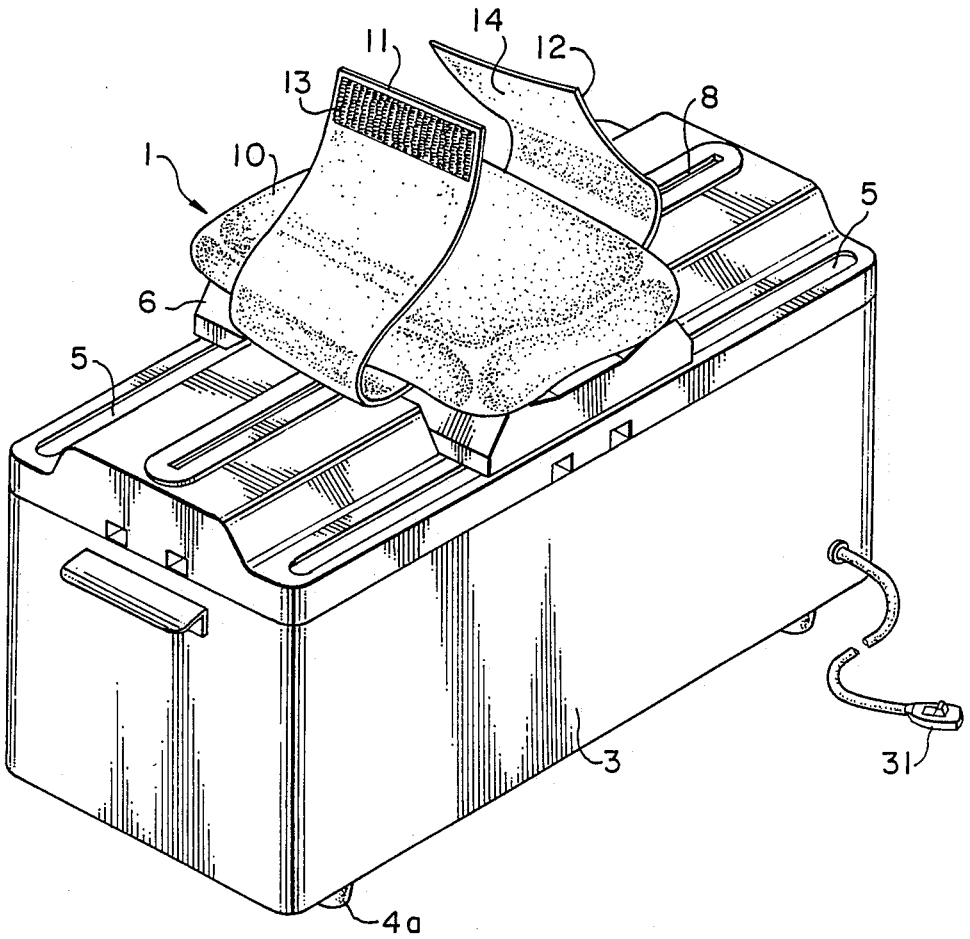
FIG. 1 is a profile perspective view showing a leg rest of a body shaking device according to the present invention.

The present invention will hereunder be described in detail in conjunction with a preferred embodiment of the body shaking device as shown in the drawings.

Figure 13:
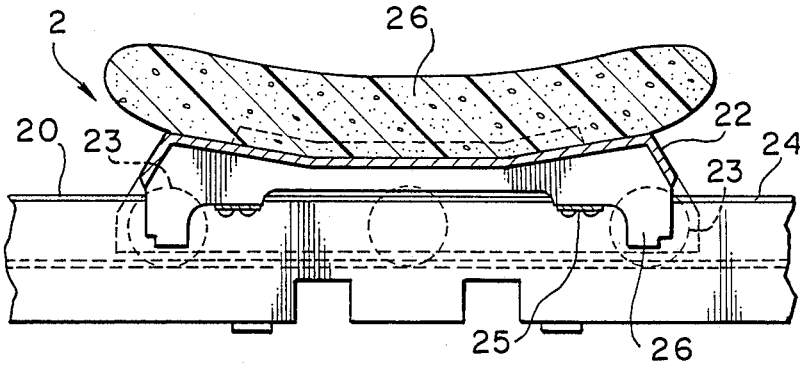
FIG. 13 is a sectional view like FIG. 5, taken across the hip rest and along the base in a lengthwise direction.
Figure 14:
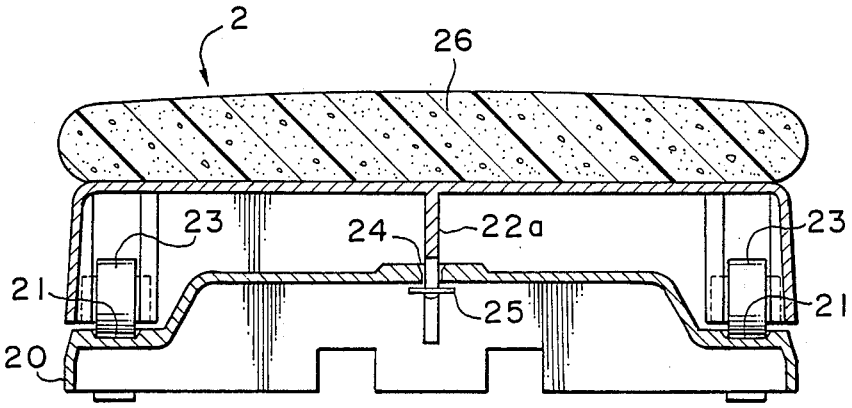
FIG. 14 is a sectional view like FIG. 6, taken along the length of the hip rest and across the base.
Figure 12:
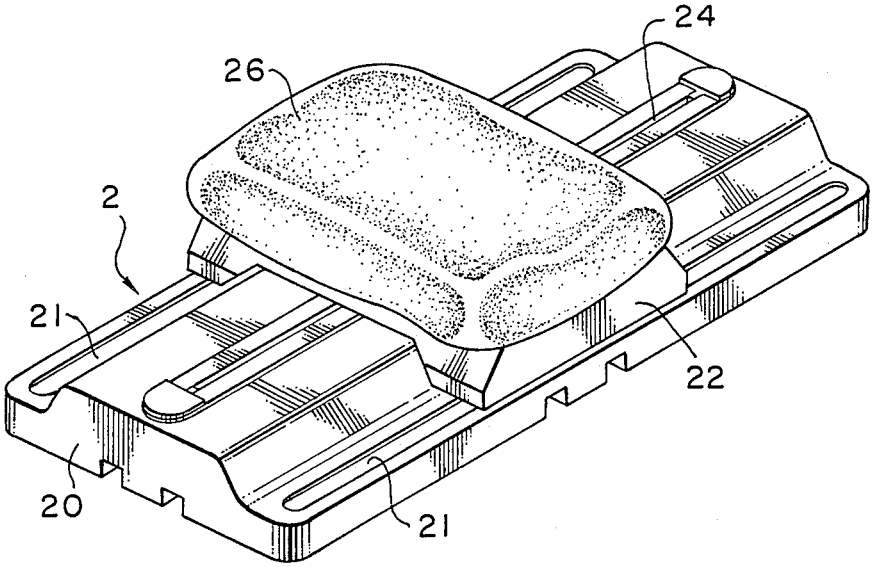
FIG. 12 is a profile perspective view further showing a hip rest of the body shaking device.

The body shaking device of the present invention includes a leg rest assembly 1 that is separate and distinct from a hip rest assembly 2. FIGS. 1 through 11 show the leg rest assembly 1 as including a rectangular box-like casing 3 and FIGS. 12 through 14 show the hip rest assembly 2. Shown best in FIGS. 3 and 4, rubber supports 4*a* are secured at positions close to right and left corners of the forward edge of the casing bottom, and rubber supports 4*b* are secured at positions close to right and left corners of the rear edge of the casing bottom. As shown, the rubber supports 4*a* are shorter than the rubber supports 4*b*. So arranged, the casing 3 will be slightly forwardly tilted as shown best in FIG. 4.

Figure 2:
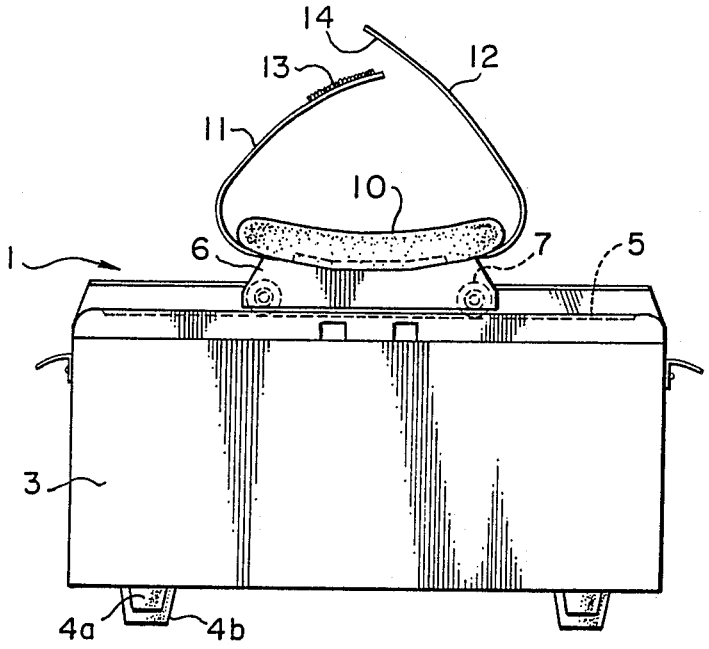
FIG. 2 is a front elevation view showing the leg rest.
Figure 3:
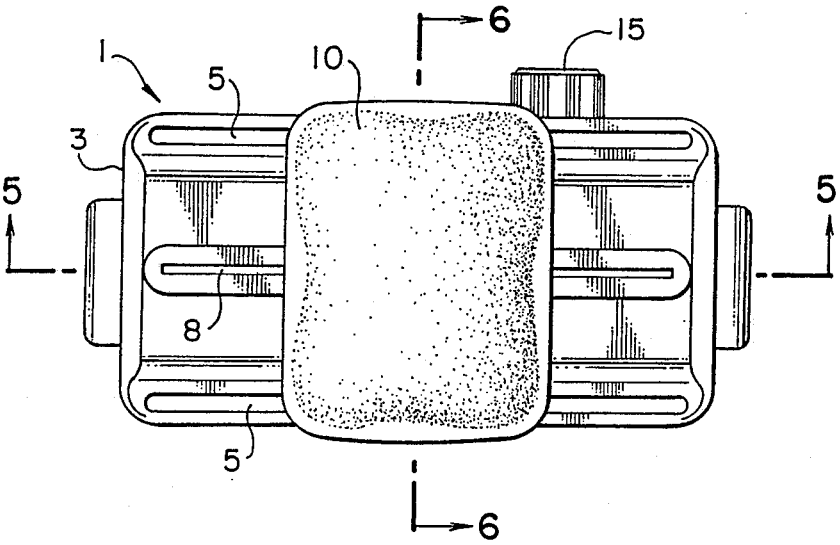
FIG. 3 is a top plan view showing the leg rest, with the belts removed.
Figure 4:
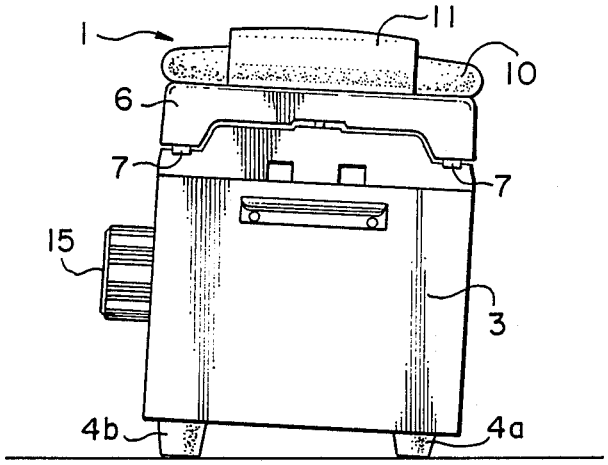
FIG. 4 is a side elevation view showing the leg rest.
Figure 5:
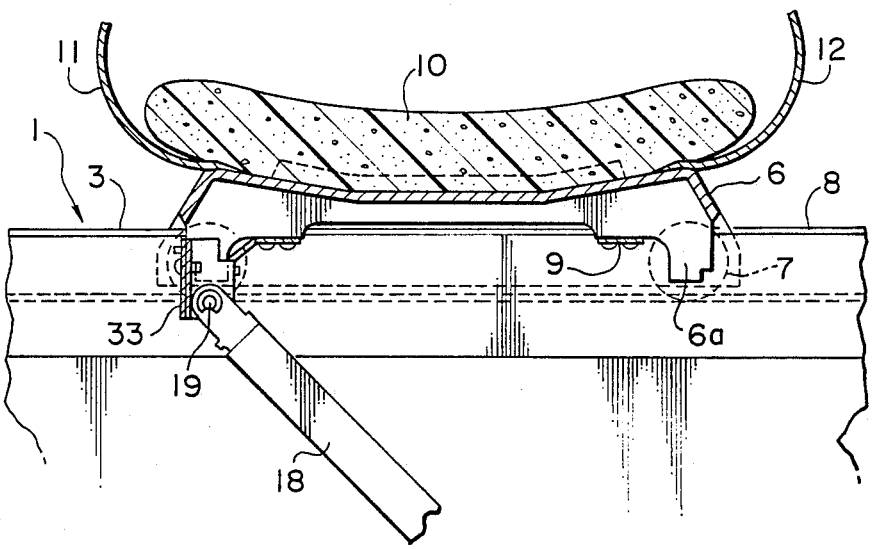
FIG. 5 is a sectional view taken along the line V—V in FIG. 3.
Figure 6:
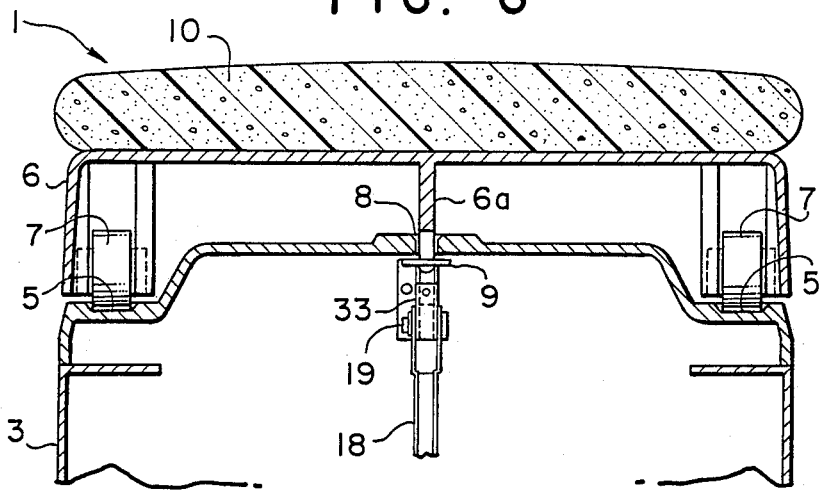
FIG. 6 is a sectional view taken along the line VI—VI in FIG. 3

As shown in FIGS. 1 through 3, a pair of first parallel rectilinear parallel track channels 5 are arranged across the casing 3 proximate, respectively, to the forward and rearward end portions of the top surface of that casing. Four (4) rollers 7 are respectively rotatably supported at four (4) corners of a leg rest 6. Rollers 7 are to be fitted into the track channels 5 in a manner to roll therealong. So arranged, the leg rest 6 is movable back and forth along the track channels 5 A slot 8 is provided in the central portion of the top surface of the casing 3 that is parallel to the track channels 5 and is for accommodating a vertical rib 6*a* traveling therein The vertical rib 6*a*, as shown in FIGS. 5 and 6, is integrally provided to and extends at approximately a right angle from across the undersurface of the leg rest 6. The vertical rib 6*a* is to fit through the slot 8 and into the interior of the casing 3, to be reciprocated therealong, as set out hereinbelow. Stops 9 are secured to extend across the lower end portions of the rib 6*a*, forming flanges that prevent the rib 6*a* from being displaced out off the slot 8, preventing the leg rest 6 from being removed from the casing 3.

Shown best in FIGS. 5 and 6, a cushion material 10 is provided to cover the top surface of the leg rest 6. Also, leg securing belts 11 and 12, as shown best in FIG. 1, are preferably centrally mounted to opposite leg rest right and left opposite sides, the ends thereof to overlap a user's lower legs. End portions of each of which leg securing belts 11 and 12 are provided with detachable press to close type fasteners 13 and 14, such as Velcro® fasteners, or the like.

Figure 7:
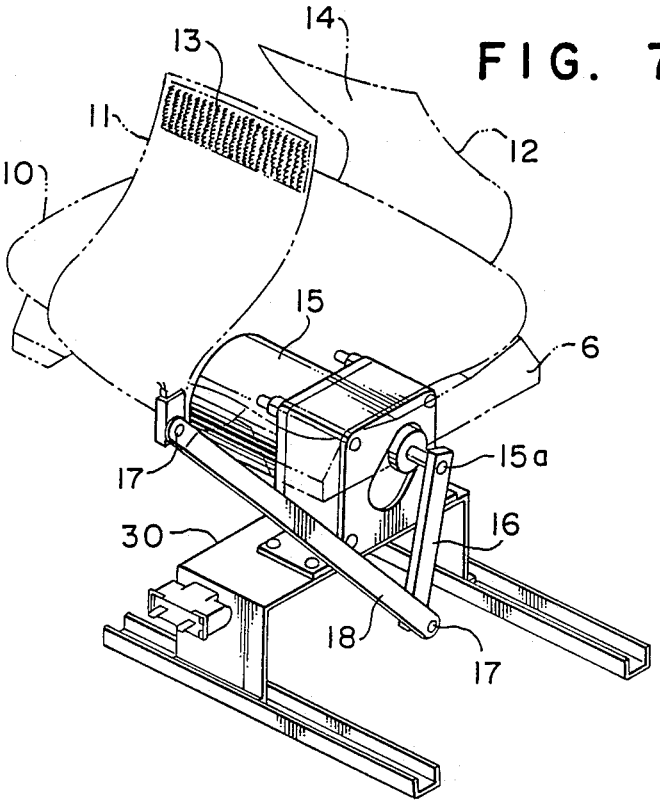
FIG. 7 is a profile perspective view showing a crank mechanism for driving the leg rest.
Figure 8:
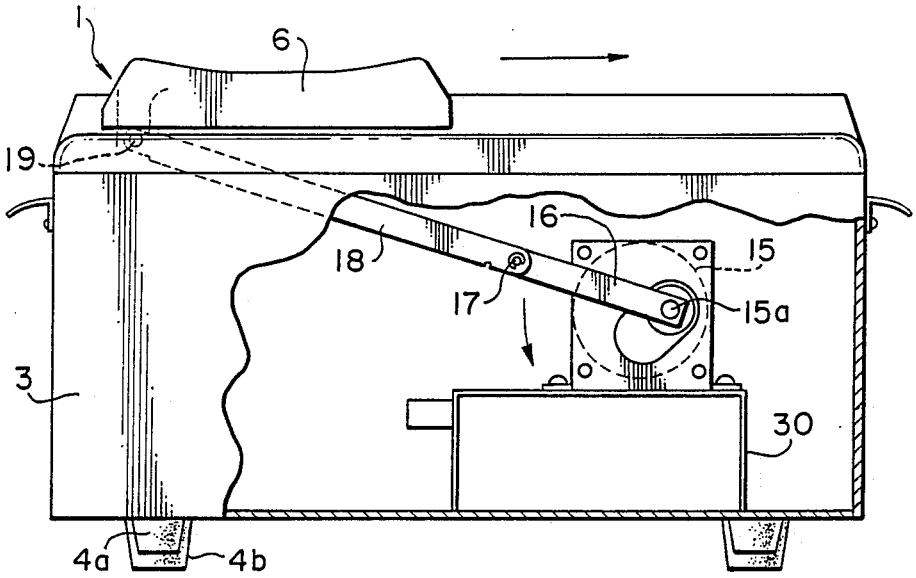
FIGS. 8 to 11 are explanatory views showing the reciprocating motion of the leg rest which is driven by a crank mechanism.
Figure 9:
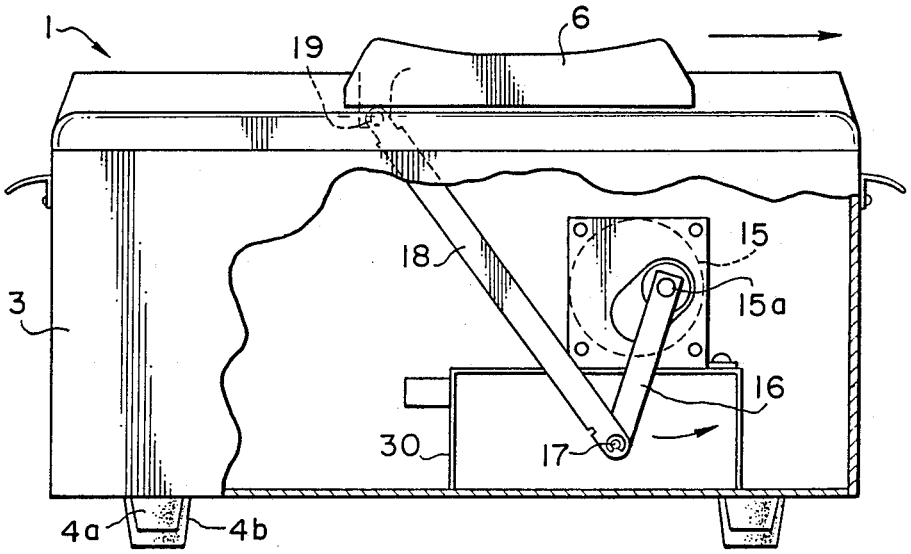
Figure 10:
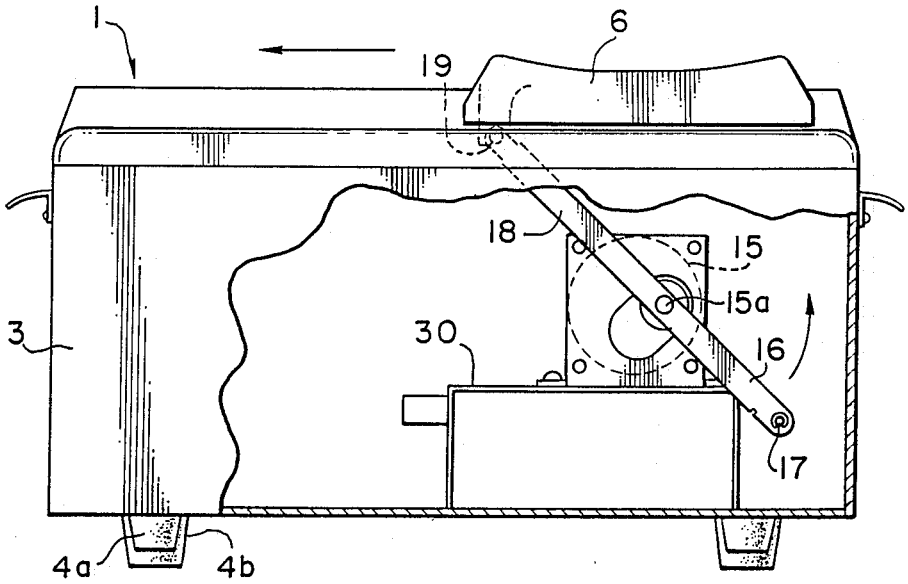
Figure 11:
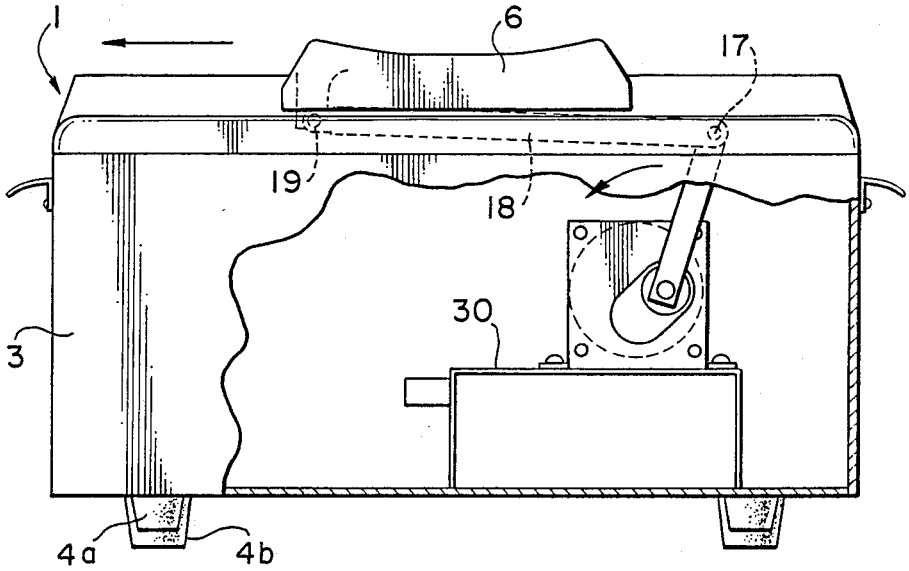

Shown best in FIGS. 7 through 9, a geared motor 15 is mounted within the casing 3 on a motor mount 30 that is, in turn, secured on frame rails of the casing 3 frame. A linkage, as set out below, is provided with motor 15 to translate an output shaft 15*a* turning into reciprocating travel of the leg rest 6 along track channels 5. The motor 15 can be operated remotely by a switch 31 that, as shown in FIG. 1, is linked by a cable to be held by a person operating the body shaking device.

Shown best in FIG. 7, the linkage for reciprocating the leg rest 6 consists of a first arm 16 that is fixed on one end to the motor output shaft 15*a*, with its other end connected through a pivot pin 17 to an end of a second arm 18. The first arm 16 is thereby rotatably connected to turn through three hundred sixty (360) degrees relative to the motor output shaft 15*a*, around pivot pin 17. The second arm, at the pivot pin 17 end, turning across the output shaft 15*a*. The opposite end of which second arm 18, as shown also in FIG. 6, is rotatably connected at a pin 19, through a hanger fixture 33 to the rib 6*a* of the leg rest 6. Which pin 19 also extends parallel to the output shaft 15*a*. The arrangement of arms 16 and 18 and their couplings together and to motor output shaft 15*a* and rib 6*a* provide the linkage for reciprocating the leg rest 6 in track channels 5. This linkage constitutes a slider crank mechanism for converting the rotary motion of the output shaft 15*a* into the straight line reciprocating motion of the leg rest 6, traveling along the track channels 5. FIGS. 8 through 11 show, with curved arrows at pivot pin 17 and straight arrows from the leg rest 6, this functioning.

FIGS. 12 through 14 show the hip rest assembly 2 of the present invention. As shown best in FIG. 12, the hip rest assembly includes a flat base 20 whereon a top surface of which are arranged a pair of parallel second rectilinear track channels 21. Which second track channels extend from side to side thereacross adjacent to the forward and rearward end portions of that top surface. A hip rest 22 is provided that includes six (6) rollers 23 that are respectively rotatably supported in two (2) rows along opposite sides of the undersurface thereof. Rollers 23 are maintained in the second track channels 21 in a manner to be rotatable therealong, such that the hip rest assembly 22 is movable on the base 20. A center slot 24 is provided in base 20 that is parallel to the track channels 21. As shown in FIGS. 13 and 14, a vertical rib 22*a* that is integral to the undersurface of the hip rest 22 extends through the slot 24 into the interior of the base 20. Spaced stops 25 are secured across the lower end portion of rib 22*a* for preventing that rib 22*a* from being removed out from the slot 24, prohibiting the hip rest 22 from being dislodged off from the base 20. A cushion material 26 is preferably provided on the top surface of the hip rest 22.

Figure 16:
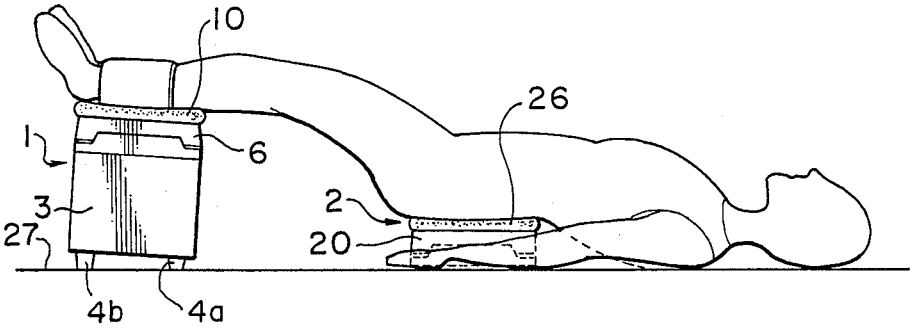
FIG. 16 is a side elevation view showing the person of FIG. 15 support on the leg and hip rests.

In practice, to use the body shaking device of the present invention, as shown in FIGS. 15 and 16, the leg rest assembly 1 and the hip rest assembly 2 are placed on a floor 27 such that the first and second track channels 5 and 21 are parallel to one another. A user seats his or her hips on the hip rest 22, and lies down in supine posture so as to be perpendicular to the casing 3 and the base 20, with the terminal parts of both legs, preferably the leg portions from the calves to ankles, on the leg rest 6. Next, the belts 11 and 12 are fitted over the terminal parts of both legs, the fastener ends 13 and 14 overlap to connect to one another.

The person holding switch 31 turns on the motor 15, that turns the output shaft 15*a*. The output shaft turning is converted into the straight line reciprocating motion by the slider crank mechanism consisting of the pivotally coupled arms 16 and 18, with arm 18 pivotally connected to move leg rest 6 in first track channels 5. Thereby, the leg rest 6 is rectilinearly reciprocated along the track channels 5 from side to side. As set out above, FIGS. 8 through 11 show the reciprocating motion of the leg rest 6 by the slider crank mechanism.

When the leg rest 6 is reciprocated from side to side, the terminal parts of the user's legs thereon are also shaken from side to side. More or less in the same way that every part of a rope will be shaken in waves when one end of that rope is forcibly shaken. The side to side shaking of the terminal parts of legs is transmitted into the user's hips and upper body. Thereby every part of the user's body will be shaken in an arc, bending each way. With the user's hips on the hip rest 22, the side to side movement of the terminal parts of their legs will cause that hip rest 22 to travel back and forth along the second track channels 21, that hip rest travel providing for the user's body to be freely shaken.

As the whole body is shaken from side to side, the spine and muscles thereabout, which are not moved much in the daily life, are moved from side to side. It is believed that a deformity of the spine is affected favorably by such movement as, it is believed, is stiffness in the back. Furthermore, the shaking of the whole body as aforesaid gives a massaging effect to the waist and shoulder areas.

Although in FIGS. 15 and 16 the user is shown resting the terminal parts of both legs in side by side arrangement on the leg rest 6, the user may alternatively rest one leg over the other. By so doing the user's abdominal region is subjected to an exercise that is similar to a situp exercise where the person twists also from side to side. Also, a user may lay on their side on the floor with the terminal parts of their legs rested on the leg rest 6, to provide an exercise effect that is similar to that provided by an exercise where a person bends back and forth at the waist. Additionally, though in FIGS. 15 and 16 the user is shown with their arms spread apart, it should be understood that a user may cross their arms over their chest during the operation of the body shaking device, and by so doing provide an additional massaging effect to their shoulders.

It should be understood that the leg securing belts 11 and 12 are not essential to the present invention, and accordingly that the terminal parts of the legs can be rested on the leg rest alone without detracting from the beneficial effects to a person utilizing the body shaking device. In such a case, where the belts are not provided, the leg rest may have a concave or convex shape to prevent the legs from falling off that leg rest. Additionally, although the casing of the leg rest and the base of the hip rest are shown as being separated from one another, it should be understood they could be formed integrally within the scope of this disclosure. Also, while the tracks formed in the casing and base are shown to be rectilinear, they could alternatively be arcuate within the scope of this disclosure. Further, use of the hip rest, it should be understood, is an option of the user who may, due to weak physical strength, age, or the like determine not to use the hip rest. The user thereby sitting directly on the floor, lowering the intensity of the side to side movement to that user's body.

A preferred embodiment of the present invention has been shown and described herein, it should, however, be obvious that the same may be varied in many ways. Such variations, however, should not be regarding as departures from the spirit and scope of the invention, and all such modifications as would be obvious to one skilled in the art are intended to be included within the scope of the following claims.

I claim:

1. A body shaking device comprising a leg rest casing; a first track mounted to extend from side to side across said leg rest casing; a leg rest that is arranged to be movable along said first track on which the terminal parts of both legs of a reclining user are rested; driving means for reciprocating said leg rest along said first track, moving said user's legs from side to side; and a separate hip rest assembly that includes a base whereon are arranged a second track that extends thereacross, and a hip rest that is arranged to be movable along said track.

2. The body shaking device as set forth in claim 1, wherein said first track consists of equal, parallel rectilinear sections.

3. The body shaking device as set forth in claim 2, wherein said driving means includes an electric motor; and a crank means interposed between said electric motor and said leg rest for converting the rotation of a drive shaft of said motor into the straight line reciprocating motion of said leg rest traveling along the first track.

4. The body shaking device as set forth in claim 1, further including means for releasably securing the terminal parts of a user's leg or legs onto the leg rest.

5. The body shaking device as set forth in claim 4, wherein said securing means is a belt.

6. The body shaking device as set forth in claim 1, wherein said second track is rectilinear.

* * * * *